United States Patent [19]

Thorsnes

[11] Patent Number: 5,048,256

[45] Date of Patent: Sep. 17, 1991

[54] COMPOSITE BEAM

[75] Inventor: Ola O. Thorsnes, Oslo, Norway

[73] Assignee: A/S Selvaagbygg, Oslo, Norway

[21] Appl. No.: 413,242

[22] Filed: Sep. 27, 1989

[51] Int. Cl.[5] ..... E04C 3/30

[52] U.S. Cl. ..... 52/730; 52/729

[58] Field of Search ..... 52/376, 377, 690, 693, 52/696, 738, 729-732; 227/155; 29/155 R

[56] References Cited

U.S. PATENT DOCUMENTS

| | | | |
|---|---|---|---|
| 1,203,283 | 10/1916 | Utzman | 52/363 |
| 2,391,250 | 12/1945 | Legowik | 52/377 |

FOREIGN PATENT DOCUMENTS

| | | | |
|---|---|---|---|
| 1199914 | 6/1959 | France | 52/693 |
| 608120 | 9/1960 | Italy | 227/155 |
| 18781 | of 1909 | United Kingdom | 227/155 |
| 125748 | 4/1919 | United Kingdom | 52/730 |
| 128076 | 6/1919 | United Kingdom | 52/376 |
| 698461 | 10/1953 | United Kingdom | 52/376 |

*Primary Examiner*—James L. Ridgill, Jr.

*Attorney, Agent, or Firm*—Burns, Doane, Swecker & Mathis

[57] ABSTRACT

A beam, especially for building houses of wood, comprises a web (1) of steel plate, preferably galvanized steel sheet metal, and transverse flanges (2, 3) constituted by wooden elements (6) arranged on either side of edge portions (4, 5) of the web (1) which have been bent back or folded at least twice. The wooden elements (6) are attached to the web (1) by means of nails (7). Wooden posts (8) are arranged along the web (1) to the web in order to protect the web against buckling. The beam combines the beneficial properties of steel and wood. The steel provides stiffness and stability, while the wood permits nailing.

21 Claims, 1 Drawing Sheet

COMPOSITE BEAM

The present invention relates to a beam or girder comprising a web having transverse flanges at its longitudinal edge portions, the web being constituted by steel plate material and said flanges consisting generally of elements of wood which are attached to the respective edge portions by way of attachment means.

In the building industry steel beams are often used as girders instead of wooden beams because they are 20–30 times less elastic, they do not shrink and have little stress relaxation. In terms of stiffness the steel is 2,5 times more cost effective than wood with today's prices. However, the steel beams have the disadvantage in houses made of wood that they cannot be nailed.

The object of the present invention is to provide a beam combining the best properties of steel and wood.

This is obtained in a beam of the type mentioned above, the beam being characterized in that the steel plate is bent back or folded at least twice at the edge portions.

Such a beam will be superior to a wooden beam with respect to stiffness, strength and cost.

In an advantageous embodiment of the invention the attachment means are constituted by nails driven transversally through the respective flange and bent at its extending end to firm engagement against the wooden element.

To make the beam stronger against buckling of the web, it is suggested according to the invention to provide it with wooden posts which are attached in pairs to the web on either side and extend transversally of the longitudinal direction of the web between the wooden elements. These posts may be arranged at evenly spaced intervals along the beam and may, like the wooden elements, be nailed to the web and each other with through-going nails. The distance between the post pairs is preferably between one and three times the total width of the web.

In order to provide the beam with optimum stiffness, in an advantageous embodiment the bent portions are arranged on either side of the web. In a preferred embodiment the web is bent to quadruple thickness at the edge portions, and the width of the bent edge portions is between 1/7 and $\frac{1}{4}$ of the total width of the web, preferably about 1/5 of the total width of the web.

The web may advantageously be constituted by galvanized steel sheet metal. This material is easily obtainable and may be bent by means of relatively simple equipment, or also by means of so-called roll forming.

Figure 1:
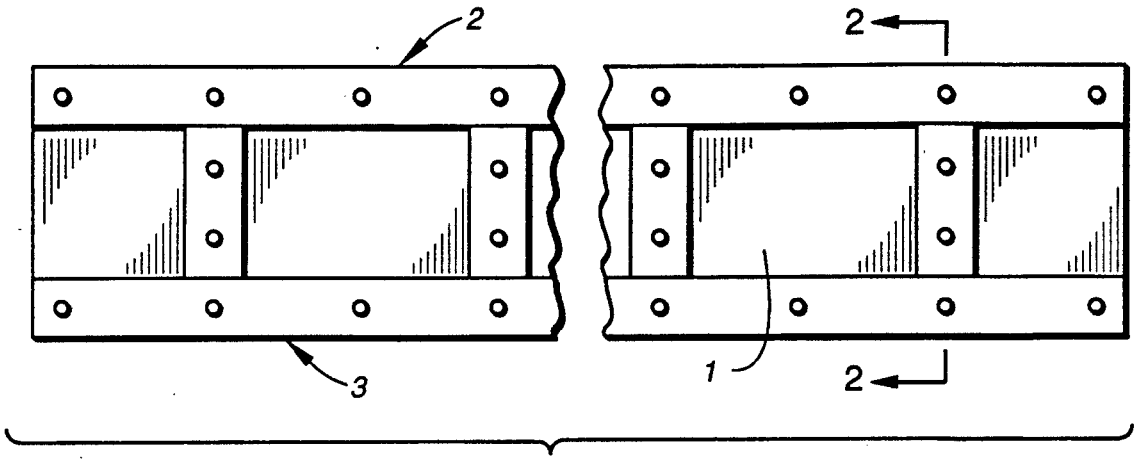
Figure 2:
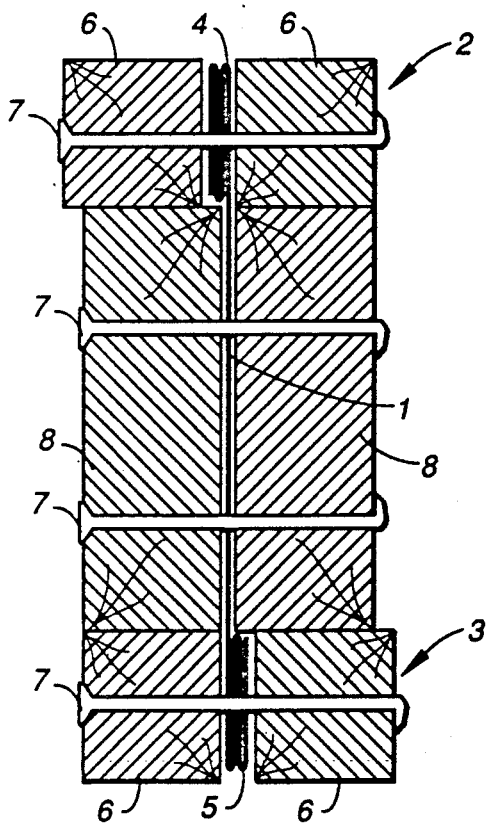

For better understanding of the invention it will be described more closely with reference to the exemplifying embodiment shown in the appended drawing, where FIG. 1 shows a side view of a beam according to the invention, and FIG. 2 shows a section at a larger scale taken along the line II—II in FIG. 1.

The embodiment of the beam according to the invention shown comprises a web 1 of galvanized steel sheet metal, having transverse flanges 2, 3 at its longitudinal edge portions 4, 5. As shown in FIG. 2, the sheet metal is bent to quadruple form at the edge portions 4, 5. On either side of these edge portions wooden elements 6 are arranged and attached by means of through-going nails 7. These nails are at their extending end bent in order to hold the wooden elements 6 firmly against the edge portions 4, 5.

It will be seen that the bent edge portions 4, 5 are located on either side of the web. In this way, the web becomes axis symmetric about its longitudinal central axis. It will be understood that the bent edge portions 4, 5 will concentrate the steel material in those portions of the beam subjected to the highest stresses when subjected to bending loads. This gives a correspondingly effective utilization of the steel material.

In order to stiffen the beam against buckling of the web 1, it is provided with wooden posts 8, which are arranged in pairs on either side of the web and extend transversally of the longitudinal direction of the web between the wooden elements 6. Also the posts 8 are attached by means of through-going nails 7.

Even though the present invention has been described with respect to a particular embodiment, it will be clear that the invention may be varied and modified in a number of ways within the scope of the appended claims. Thus, it is possible to use other attachment means than nails in order to attach the wooden elements to the web, such as e.g. screws, and it may also be beneficial to use glue in addition to e.g. the nails.

If one desires a stronger beam but does not wish to increase the thickness of the steel plate material in the web, it is possible to use two adjacent webs. The bent edge portions must in this case be located on the same side of the web in question.

The number of bends in the edge portions may of course be varied as required and one also envisions to extend the last bent portion somewhat and bend it at right angles away from the web so as to form an edge against which the wooden element may rest. This edge will make the wooden element less prone to yielding when used for nailing.

One has also envisioned a beam where each edge portion of the web is provided with a wooden element only on one side. In this case the wooden element should be arranged on the opposite side from the bends.

I claim:

1. A beam comprising:

a web with transverse flanges at its longitudinal edge portions, the web including a single steel plate and the transverse flanges including elements of wood which are attached to the respective edge portions to provide exposed wooden surfaces on at least two sides of the web;

attachment means for attaching the transverse flanges to the longitudinal edge portions of the steel plate, characterized in that the steel plate at the edge portions is bent back.

2. A beam according to claim 1 wherein the web is bent to quadruple form in the edge portions.

3. A beam according to claim 1 wherein the attachment means are nails that are driven all the way through the respective flange and is at its extending end bent to firm engagement against the wooden element.

4. A beam according to claim 1 wherein the width of the bent portions is between 1/7 and $\frac{1}{4}$ of the total width of the web.

5. A beam according to claim 4 wherein the width of the bent portions is approximately 1/5 of the total width of the web.

6. A beam according to claim 1 wherein wooden posts are attached in pairs on either side of the web and extend transversely of the longitudinal direction of the web between the wooden elements.

7. A beam according to claim 6 wherein the posts are arranged evenly spaced along the beam.

8. A beam according to claim 6 wherein the distance between the posts along the beam is between one to three time the total width of the web.

9. A beam according to cláim 7 wherein the distance between the posts along the beam is between one to three time the total width of the web.

10. A beam according to claim 1 wherein the bent edge portions are located on either side of the web and are folded to at least triple thickness, the folded parts being bent back in close proximity to each other.

11. A beam according to claim 10 wherein the web is bent to quadruple from in the edge portions.

12. A beam according to claim 2 wherein the attachment means are nails that are driven all the way through the respective flange and is at its extending end bent to firm engagement against the wooden element.

13. A beam according to claim 2 wherein the width of the bent portions is between 1/7 and ¼ of the total width of the web.

14. A beam according to claim 13 wherein the width of the bent portions is approximately 1/5 of the total width of the web.

15. A beam according to claim 2 wherein wooden posts are attached in pairs on either side of the web and extend transversely of the longitudinal direction of the web between the wooden elements.

16. A beam according to claim 15 wherein the posts are arranged evenly spaced along the beam.

17. A beam according to claim 16 wherein the distance between the posts along the beam is between one to three time the total width of the web.

18. A beam comprising a web with transverse flanges at its longitudinal edge portions, the web including a steel plate and the transverse flanges including wooden elements which are attached to the respective longitudinal edge portions to provide exposed wooden surfaces on at least two sides of the web; attachment means for attaching the transverse flanges to the longitudinal edge portions of the steel plate, characterized in that the steel plate at the edge portions is folded at least twice.

19. A beam according to claim 18 wherein the width of the bent portions is between 1/7 and ¼ of the total width of the web.

20. A beam according to claim 18 wherein the bent edge portions are located on either side of the web and are folded to at least triple thickness, the folded parts being bent back in close proximity to each other.

21. A beam according to claim 20 wherein the web bent edge portions are bent to quadruple form in the edge portions.

* * * * *